US007309297B1

(12) United States Patent
Solari

(10) Patent No.: US 7,309,297 B1
(45) Date of Patent: Dec. 18, 2007

(54) INSIDE WEIGHT SYSTEM FOR GOLF MALLETS OR BLADES

(76) Inventor: Ray Solari, 531 Main St., Suite 1105, El Segundo, CA (US) 90245

( * ) Notice: Subject to any disclaimer, the term of this patent is extended or adjusted under 35 U.S.C. 154(b) by 0 days.

(21) Appl. No.: 11/607,214

(22) Filed: Dec. 1, 2006

(51) Int. Cl.
*A63B 53/04* (2006.01)
*A63B 53/08* (2006.01)

(52) U.S. Cl. ..... 473/334; 473/339; 473/409; 473/256

(58) Field of Classification Search ..... 473/334–339, 473/256, 409
See application file for complete search history.

(56) References Cited

U.S. PATENT DOCUMENTS

| | | | | |
|---|---|---|---|---|
| 2,517,245 | A | 8/1950 | Scott | |
| 3,466,047 | A * | 9/1969 | Rodia et al. | 473/338 |
| 3,652,094 | A | 3/1972 | Glover | |
| 4,043,563 | A | 8/1977 | Churchward | |
| 4,052,075 | A | 10/1977 | Daly | |
| 4,085,934 | A * | 4/1978 | Churchward | 473/338 |
| 4,340,230 | A | 7/1982 | Churchward | |
| 4,655,459 | A | 4/1987 | Antonious | |
| 4,730,830 | A | 3/1988 | Tilley | |
| 4,754,977 | A | 7/1988 | Sahm | |
| 5,046,740 | A | 9/1991 | D'Eath | |
| 5,050,879 | A | 9/1991 | Sun et al. | |
| 5,253,869 | A | 10/1993 | Dingle et al. | |
| 5,348,295 | A | 9/1994 | Phillips | |
| 5,429,356 | A | 7/1995 | Dingle et al. | |
| D368,504 | S | 4/1996 | Sommerhauser | |
| 5,746,664 | A | 5/1998 | Reynolds, Jr. | |
| 5,839,974 | A | 11/1998 | McAllister | |
| 6,089,994 | A * | 7/2000 | Sun | 473/338 |
| 6,348,014 | B1 | 2/2002 | Chiu | |
| 6,409,612 | B1 | 6/2002 | Evans et al. | |
| 6,458,044 | B1 | 10/2002 | Vincent et al. | |
| 6,527,649 | B1 | 3/2003 | Neher et al. | |
| 6,641,487 | B1 | 11/2003 | Hamburger | |
| 6,773,360 | B2 | 8/2004 | Willett et al. | |
| D497,402 | S | 10/2004 | Moore | |
| 2002/0032075 | A1 | 3/2002 | Vatsvog | |
| 2002/0098908 | A1 | 7/2002 | James et al. | |
| 2003/0232661 | A1 | 12/2003 | Greer, Jr. | |
| 2004/0029647 | A1 | 2/2004 | Bennett | |
| 2004/0058744 | A1 | 3/2004 | Solheim et al. | |
| 2004/0171433 | A1 | 9/2004 | Ashton | |
| 2004/0242343 | A1 | 12/2004 | Chao et al. | |

FOREIGN PATENT DOCUMENTS

| | | |
|---|---|---|
| WO | WO 82/01827 | 6/1982 |

* cited by examiner

*Primary Examiner*—Sebastiano Passaniti

(57) ABSTRACT

A weight system for a golf club. The golf club has an impact head, which is swung by a golfer to strike a golf ball. The weight system has at least one cavity within the impact head of the golf club; a plurality of weights, shaped and dimensioned to slidingly fit within the cavity; and a top plate on an upper surface of the impact head, the top plate covering the cavity to prevent the weights from dislodging from the cavity. The top plate is removable to provide access to the cavity for the insertion or removal of the weights.

8 Claims, 3 Drawing Sheets

INSIDE WEIGHT SYSTEM FOR GOLF MALLETS OR BLADES

TECHNICAL FIELD

This invention relates to weighting systems for golf clubs, particularly mallets or blades.

BACKGROUND ART

Golf clubs typically require precise strokes to properly strike a golf ball. This is especially so for putting strokes, which tend to require a precise "feel" to accurately and consistently make successful putts. One way to vary this feel is to provide a golf club that has variable weight characteristics in that the distribution of the weight can be adjusted to provide the feel that the golfer is seeking. To increase stability and impact of the ball, it is also beneficial if the weights can be added in line with the point of impact with the ball, which is typically along the centerline of the club's head.

As such, there is a need to provide a golf club in which the weight can be distributed and adjusted. There is also a need that the weight system permits adjustment and installation of the weights along the centerline of the club's head. Additionally, there is a need that the weights be easily accessible and removable from the club's head.

DISCLOSURE OF INVENTION

The present invention is directed to a weight system for a golf club. The golf club has an impact head, and the impact head includes an upper surface. The impact head is swung by a golfer to strike a golf ball. The weight system has at least one cavity within the impact head of the golf club; a plurality of weights, shaped and dimensioned to slidingly fit within the cavity; and a top plate on the upper surface of the impact head, the top plate covering the cavity to prevent the weights from dislodging from the cavity. The top plate is removable to provide access to the cavity for the insertion or removal of the weights.

BRIEF DESCRIPTION OF DRAWINGS

The lines provided in the figures to define the sectional views are approximations of the locations of the referenced sectional views and are intended only to provide an approximate reference as well as a view to show varying embodiments. As such, it is understood that the relevant section views are not intended to be an exact sectional of the figure in which it is defined. For example.

FIG. 2 is a front sectional view of the embodiment depicted in FIG. 1, showing the top plate and the weights in exploded form.

FIG. 3 is a side sectional view of the embodiment depicted in FIG. 1, except the top plate is in place.

FIG. 6 is a side sectional view of the embodiment depicted in FIG. 5, except the access panel and the weights are shown in exploded form.

BEST MODE FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
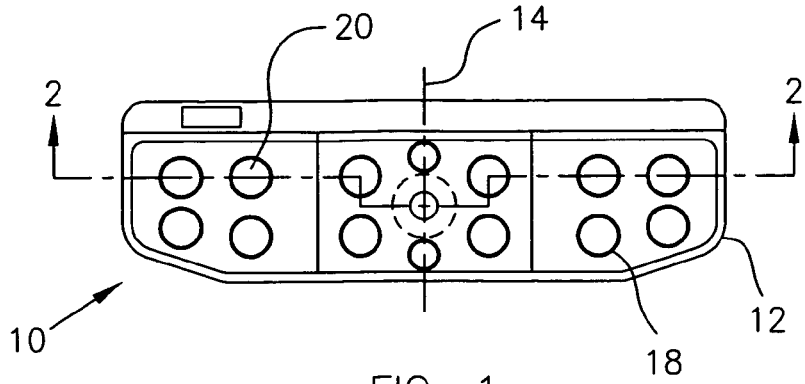
FIG. 1 is a top plan view of an embodiment of an Inside Weight System for Golf Mallets or Blades with a top plate removed.
Figure 2:
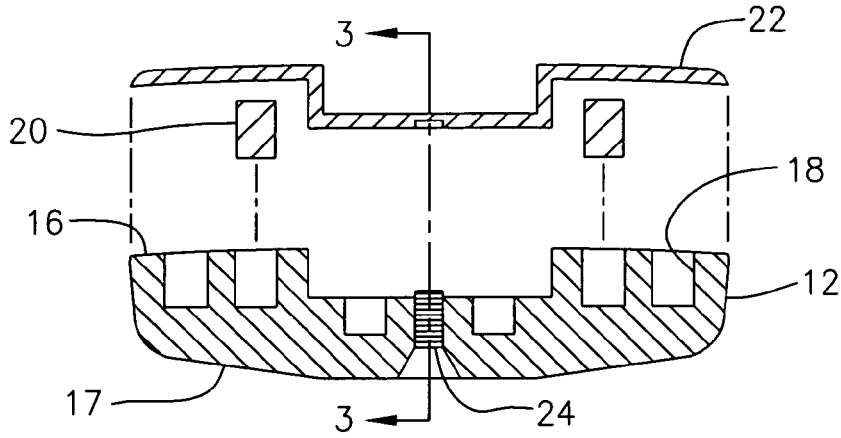
FIG. 2 depicts a top plate that is not shown in FIG. 1.
Figure 3:
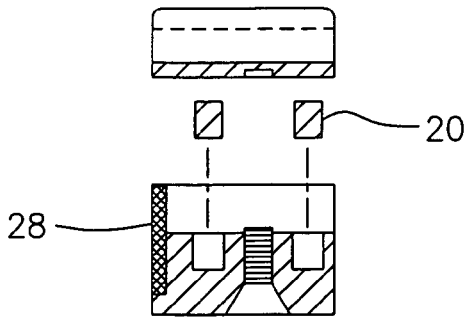
FIG. 3 depicts weights along the section line that are not shown in FIG. 2.

Referring to the figures, a weight system 10 for a golf club swung by a golfer to hit a golf ball has at least one at least one cavity 18, a plurality of weights 20, and a top plate 22. Although adaptable for various golf club designs, the invention is particularly useful for a blade golf club head, an example of which is depicted in FIGS. 1-3, and a mallet golf club head, an example of which is depicted in FIGS. 4-7.

Figure 4:
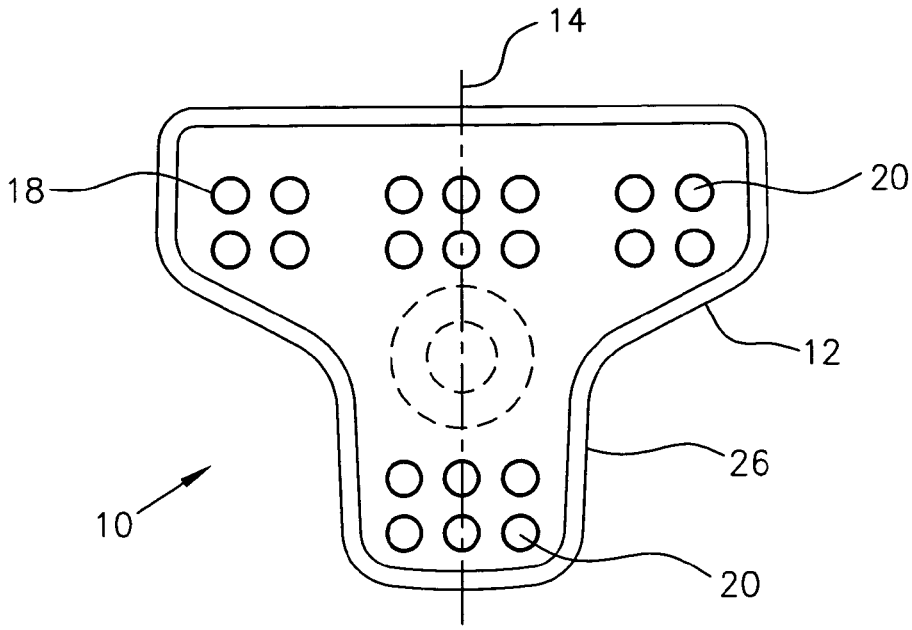
FIG. 4 is a top plan view of an embodiment of an Inside Weight System for Golf Mallets or Blades with an access panel removed.
Figure 5:
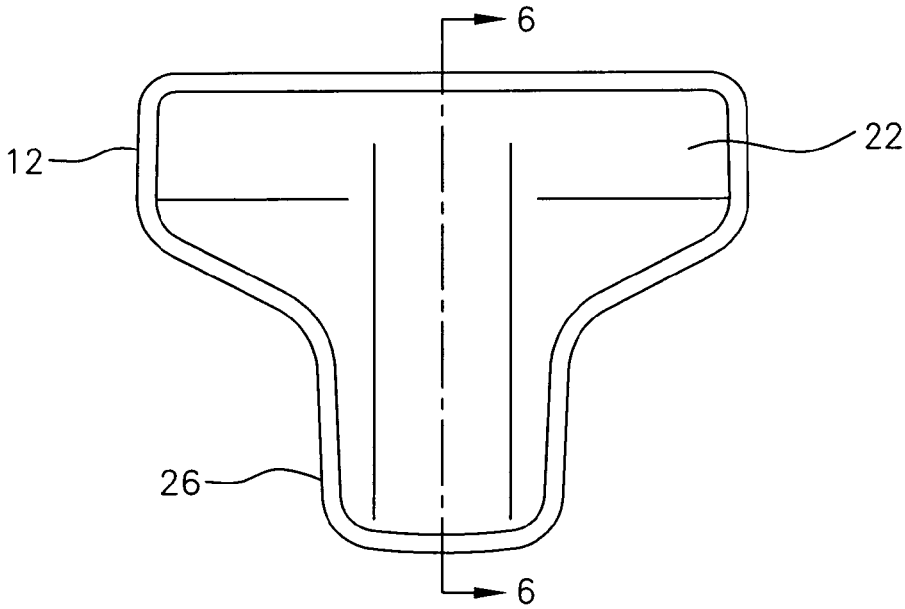
FIG. 5 is a top plan view of an embodiment of an Inside Weight System for Golf Mallets or Blades with an access panel in place.
Figure 6:
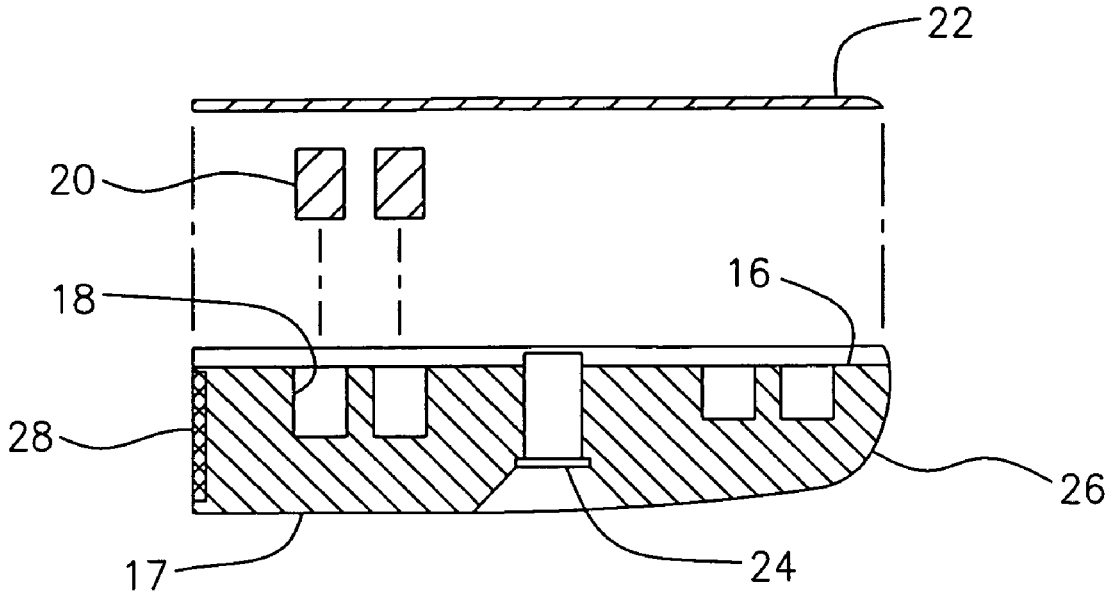
FIG. 6 shows an access panel and weights in exploded form.
Figure 7:
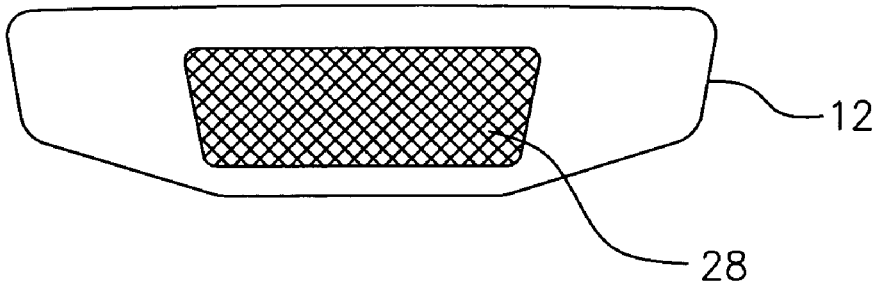
FIG. 7 is a front view of the embodiment depicted in FIG. 5.

The golf club has a head 12, and the head 12 has a centerline 14, a top side 16, and a bottom side 17. The centerline 14 is generally parallel to the direction of travel of the head 12 when swung by the golfer and is generally in line with the point on the head 12 that impacts the golf ball (which is typically on the impact face 28). The centerline 14 further may be a line of symmetry of the head 12 in that the head 12 is generally symmetrical about the line. An example of a centerline 14 that is also a line of symmetry is depicted in FIG. 1 and FIG. 4.

The at least one cavity 18 is internal to the head 12 of the golf club. In a version of the invention, the at least one cavity 18 is cylindrical. In versions having more than one cavity 18, each of the cavities may be the same size and shape. For embodiments having more than one cavity 18, preferably at least one of the cavities is located along the centerline 14 of the head 12 of the golf club, particularly for a mallet style golf club. Installation of one or more of the plurality of weights 20 along the centerline 14 permits the golfer to add weight to the golf club without having to unbalance or counterbalance an off-center-mounted weight. Furthermore, it may be beneficial to have the weight concentrated along the centerline 14 such that the weight is inline with the impact point where the golf club strikes the golf ball. In this way, the golf club may be weighted, yet there is less chance of imparting an unwanted torque or spin to the golf ball from an off-center weight. In some embodiments, though, the golfer may prefer to impart a corrective torque or spin to the golf ball. As such, the golfer may choose to keep the golf club unbalanced by applying more weight to one side than the other of the centerline. Where the golf club head is a mallet having a heel portion 26 opposite the impact face 28 that strikes the golf ball, one or more of the plurality of weights 20 may also be installed in the heel portion of the mallet. An example of a mallet head for a golf club is depicted FIG. 4. The variety of the available locations for the at least one cavity 18 permits the user to accurately adjust the weight and the weight distribution of the head 12 so that the user may obtain the desired feel.

The plurality of weights 20 are each shaped and dimensioned to fit within the at least one cavity 18, preferably by sliding. The plurality weights 20 are preferably made from metal and, in particular, may be made from aluminum, brass, steel, or tungsten. In some embodiments, a portion of the plurality of weights 20 may be made from one material, while another portion is made from a different material having a different density. Due to the different densities of the different materials, in such embodiments, the user is provided with a variety of weights to obtain the desired feel in the golf club. In a version of the invention, each of the plurality of weights 20 may be cylindrical. One or more of the fasteners 24 may also function as one or more of the plurality of weights 20 in some embodiments.

In a version of the invention, each of the plurality of weights 20 may be the same size and shape. In versions where the cavities 18 are also each of the same size and shape, any one of the plurality of weights 20 may then interchangeably fit into any one of the cavities 18. When these features are combined with embodiments having portions of the plurality of weights 20 made from materials of different densities, the user is provided with similarly sized weights 20 having different masses, yet that will fit into any one of the cavities 18.

The head 12 has a top plate 22 located at the top side 16 of the head 12. The top plate 22 covers the at least one cavity 18 to prevent the plurality of weights 20 from dislodging from the at least one cavity 18. The top plate 22 is removable to provide access to the at least one cavity 18 for the insertion or removal of the plurality of weights 20. As such, the plurality of weights 20 is removable and interchangeable to provide an adjustable weight distribution within the head 12 of the head 12, particularly in embodiments having more than one cavity 18. In some embodiments, access may be via an access panel, which in some versions is not located at the top side 16 of the head 12. For example, the access panel may be located on a lateral side or underside of the head 12.

In some embodiments, the top plate 22 is attached to the head 12 by a single fastener 24, such as a screw, peg, or tab. The single fastener 24 allows rapid access to the at least one cavity 18 and the weights 20 therein. In some embodiments, there may be more than one fastener 24. The fastener 24 may extend through the top plate 22 to attach the top plate 22 to the head 12; alternatively the fastener 24 may extend from the bottom side 17 through the head 12 to attach the top plate 22 to the head 12. To further benefit from the rapid access to the at least one cavity 18, it is also preferred that the weights 20 are not threaded into the head 12 of the golf club. Rather, it is preferred that the weights 20 can be slid in and out of the golf club.

A method of using the weight system 10 has the steps of providing a golf club having a cavity within an impact head of the golf club and having an access plate, the access plate covering and providing access to the cavity; providing a plurality of weights, each shaped and dimensioned to individually fit within the cavity; selecting one or more of the plurality of weights for insertion into the cavity; removing the access plate to provide access to the cavity; sliding the selected weight into the cavity; and replacing the access plate to cover the cavity and prevent the selected weight from dislodging from the cavity. The provided plurality of weights may include weights of different masses, as discussed above. In a version of the invention, the step of removing the access plate the access panel involves unfastening a single fastener.

While the present invention has been described with regards to particular embodiments, it is recognized that additional variations of the present invention may be devised without departing from the inventive concept.

INDUSTRIAL APPLICABILITY

This invention can be applied to the development, manufacture, and use of weighting systems for golf clubs, particularly mallets or blades.

What is claimed is:

1. A weight system for a golf implement swung by a golfer to hit a golf ball, the golf implement having a blade head, the blade head having a centerline, a bottom side and a top side, the weight system comprising:

(a) a plurality of cylindrical, smooth-walled cavities internal to the blade head of the golf implement;

(b) a plurality of cylindrical, smooth-surfaced weights, each shaped and dimensioned to slidingly fit within at least one of the plurality of cylindrical cavities;

(c) the blade head having a top plate located at the top side of the blade head, the top plate being attached to the blade head by a single fastener, the top plate covering the plurality of cavities to prevent the plurality of weights from dislodging from the plurality of cavities, the top plate being removable to provide access to the plurality of cavities for the insertion or removal of the weights, the single fastener comprising a threaded screw installed into a beveled hole central the bottom side of the blade head;

wherein at least two of the plurality of cavities are located along the centerline of the blade head of the golf implement, the centerline being generally parallel to a direction of travel of the blade head when swung by the golfer and being generally in line with a location on the blade head that impacts the golf ball; and wherein each of the plurality of cylindrical weights are removable and interchangeable to provide an adjustable weight distribution within the blade head of the golf implement.

2. The weight system of claim 1, the plurality of cylindrical weights comprising a material selected from the group consisting of aluminum, brass, steel, and tungsten.

3. A weight system for a golf club, the golf club having a mallet impact head, the mallet impact head having an upper surface, the mallet impact head being attached to a handle and swung by a golfer to strike a golf ball, the weight system comprising:

(a) a plurality of cylindrical, smooth-walled cavities within the mallet impact head of the golf club;

(b) a plurality of smooth-surfaced weights, each shaped and dimensioned to slidingly fit within at least one of the plurality of smooth-walled cavities;

(c) a top plate on the upper surface of the mallet impact head, the top plate covering the plurality of smooth-walled cavities to prevent the smooth-surfaced weights from dislodging from the cavities, the top plate being removable to provide access to at least one of the plurality of smooth-walled cavities for the insertion or removal of the smooth-surfaced weights;

(d) the mallet impact head having a centerline, the centerline being generally parallel to a direction of travel of the mallet impact head when swung by the golfer and being generally in line with a location on the mallet impact head that impacts the golf ball, wherein at least two of the plurality of cavities are along the centerline of the golf club; and (e) the top plate being secured to the mallet impact head by a single fastener, the single fastener comprising a threaded screw installed into a beveled hole central a bottom side of the mallet impact head.

4. The weight system of claim 3, each of the plurality of cavities being congruently shaped and dimensioned.

5. The weight system of claim 4, each of the plurality of smooth-surfaced weights being congruently shaped and dimensioned, the smooth-surfaced weights thereby being insertable into any of the plurality of cavities.

6. The weight system of claim 3, the plurality of smooth-surfaced weights being made from aluminum, brass, steel, or tungsten.

7. A method of providing an adjustable weight distribution within a golf putter, the method comprising the steps of:

(a) providing a golf putter having a plurality of smooth-walled cavities within an impact head of the golf putter and having an access plate, the access plate being located at an upper surface of the impact head, the access plate covering and providing access to at least one of the smooth-walled cavities;

(b) providing a plurality of smooth-surfaced weights, each shaped and dimensioned to individually fit within at least one of the smooth-walled cavities;

(c) selecting one or more of the plurality of smooth-surfaced weights for insertion into at least one of the smooth-walled cavities;

(d) removing the access plate to provide access to the smooth-walled cavities by unfastening a single fastener, the single fastener comprising a threaded screw installed into a beveled hole central a lower surface of the impact head;

(e) sliding the selected one or more of the plurality of smooth-surfaced weights into at least one of the smooth-walled cavities; and (f) replacing the access plate to cover the smooth-walled cavities and prevent the selected one or more of the plurality of smooth-surfaced weights from dislodging from the smooth-walled cavities.

8. The method of claim 7, the provided plurality of smooth-surfaced weights including weights of different masses.

* * * * *